US006019331A

United States Patent [19]

Hoogland et al.

[11] Patent Number: 6,019,331

[45] Date of Patent: Feb. 1, 2000

[54] CANTILEVER BRACKET ASSEMBLY

[75] Inventors: Timothy A. Hoogland, Zeeland; Eugene L. Karn, Holland; Thomas J. Newhouse, Grand Rapids, all of Mich.

[73] Assignee: Herman Miller, Inc., Zeeland, Mich.

[21] Appl. No.: 08/865,587

[22] Filed: May 28, 1997

Related U.S. Application Data

[60] Provisional application No. 60/019,285, Jun. 7, 1996.

[51] Int. Cl.[7] ..... A47B 57/00

[52] U.S. Cl. ..... 248/250; 211/187; 108/108

[58] Field of Search ..... 248/235, 225.11, 248/225.21, 224.8, 220.22, 250, 243; 211/187, 193, 207, 208, 103, 90; 108/108, 152, 153, 144.11

[56] References Cited

U.S. PATENT DOCUMENTS

| | | | |
|---|---|---|---|
| 1,059,464 | 4/1913 | Hine | 211/187 |
| 1,937,935 | 12/1933 | Zimmerman | 211/136 |
| 2,790,559 | 4/1957 | Stephenson et al. | 211/136 |
| 2,816,669 | 12/1957 | Schild | 108/108 |
| 3,082,880 | 3/1963 | Mapson | 211/153 |
| 3,088,424 | 5/1963 | Knuth | 108/108 |
| 3,097,022 | 7/1963 | Attwood | 248/250 |
| 3,263,821 | 8/1966 | Klene et al. | 211/148 |
| 3,299,839 | 1/1967 | Nordbak | 108/152 |
| 3,325,130 | 6/1967 | Smith et al. | 248/247 |
| 3,351,212 | 11/1967 | McConnell | 211/177 |
| 3,487,790 | 1/1970 | Rous | 108/111 |
| 3,556,306 | 1/1971 | Shell | 211/190 |
| 3,587,867 | 6/1971 | Fenwick et al. | 211/183 |
| 3,601,432 | 8/1971 | Fenwick et al. | 287/189.36 |
| 3,602,159 | 8/1971 | Marschak | 108/111 |
| 3,697,034 | 10/1972 | Shell | 248/243 |
| 3,713,257 | 1/1973 | Beavers | 52/36 |
| 3,794,281 | 2/1974 | Munsey | 248/188 |
| 4,013,254 | 3/1977 | Boundy | 248/243 |
| 4,018,167 | 4/1977 | Spangler | 108/152 |
| 4,133,433 | 1/1979 | Wolf | 211/192 |
| 4,154,419 | 5/1979 | Breidenbach | 248/243 |
| 4,205,815 | 6/1980 | Sauer et al. | 248/243 |
| 4,312,086 | 1/1982 | Bianco | 5/2 R |
| 4,387,872 | 6/1983 | Hogue | 248/221.3 |
| 4,513,669 | 4/1985 | Steinke | 108/111 |
| 4,515,494 | 5/1985 | Robilliard et al. | 403/187 |
| 4,671,481 | 6/1987 | Beard | 248/222.1 |
| 4,684,094 | 8/1987 | Everett | 248/245 |
| 4,700,916 | 10/1987 | Bastian et al. | 248/225.2 |
| 4,733,841 | 3/1988 | Wilson | 248/222.1 |
| 4,874,322 | 10/1989 | Dola et al. | 439/210 |
| 5,022,621 | 6/1991 | Quest | 248/225.2 |
| 5,063,715 | 11/1991 | Goodman | 52/36 |
| 5,154,388 | 10/1992 | Magaro | 248/248 |
| 5,188,326 | 2/1993 | Zich | 248/225 |
| 5,199,585 | 4/1993 | Schafer | 211/187 |
| 5,205,421 | 4/1993 | Bustos | 211/59.2 |
| 5,230,492 | 7/1993 | Zwart et al. | 248/222.1 |
| 5,297,486 | 3/1994 | Herrmann et al. | 108/108 |
| 5,406,894 | 4/1995 | Herrmann et al. | 108/108 |
| 5,433,327 | 7/1995 | Benvenuti et al. | 211/193 |
| 5,494,246 | 2/1996 | McCarthy et al. | 248/221.11 |
| 5,538,213 | 7/1996 | Brown | 248/222.11 |

FOREIGN PATENT DOCUMENTS

| | | | |
|---|---|---|---|
| 821491 | 10/1959 | United Kingdom | 248/242 |
| 880471 | 10/1961 | United Kingdom | 248/250 |

*Primary Examiner*—Peter M. Cuomo
*Assistant Examiner*—Gerald A. Anderson
*Attorney, Agent, or Firm*—Brinks Hofer Gilson & Lione

[57] ABSTRACT

A cantilever bracket assembly for attaching horizontal components to a side of a vertical wall. The bracket assembly comprising a bracket member and a support member having a rear portion adapted to releasably engage the wall and a substantially vertical web attached to the rear portion. The web has a first and second side and a top edge. A plurality of upwardly extending tab members are attached to one of the bracket member and the web, wherein the tab members are laterally offset from at least one of the first and second sides of the web when attached to the web. The bracket member is provided with a top portion adapted to engage the horizontal component. The bracket member has one of a plurality of hanger members and tab members adapted to receive the other of plurality of tab members and hanger members attached to the web. The bracket member is mounted on the support bracket by disposing the tab members in the hanger members.

36 Claims, 4 Drawing Sheets

CANTILEVER BRACKET ASSEMBLY

This application claims the benefit of U.S. Provisional Application No. 60/019,285, Filed Jun. 7, 1996.

BACKGROUND OF INVENTION

The present invention relates generally to a bracket assembly for supporting components on a wall, and more particularly, to a cantilever bracket assembly for attaching horizontal components, such as worksurface members, to a side of a vertical wall.

Wall panel systems of the type used in office environments are commonly configured with various horizontal components, such as shelving or worksurface members. Typically, such horizontal components are supported by cantilever brackets extending outwardly from a vertical wall. The brackets, such as that shown in U.S. Pat. No. 5,297,486, entitled BRACKET AND SHELF, and issued Mar. 29, 1995, typically include a vertical support web that carries the bending moment and a horizontal mounting flange that supports the component.

The mounting flange typically is formed integrally with the support web, or is fixedly attached to the support web with mechanical fasteners or by welding. Typically, such bracket assemblies are configured with the mounting flange extending from one side of the web or the other, or from both sides. With such bracket systems, an installer typically must maintain three or more types of bracket components in inventory in order to provide a left-hand support, a right-hand support and a bridge-type support.

Alternatively, some bracket systems have either separable vertical supports and horizontal mounting portions, or omit the horizontal mounting portion of the bracket altogether, as shown in U.S. Pat. No. 5,205,421, entitled GONDOLA DISPLAY RACK and issued Apr. 27, 1993. In the latter embodiment, the horizontal component being supported, shown as shelving, is attached directly to the vertical support web of the bracket. The same vertical support web, however, cannot be used to support a right-hand shelf and a left-hand shelf at the same time. Similarly, the support cannot function as a bridge-type support in the middle of an elongated shelf. Thus, the installer must maintain numerous bracket components in inventory if it is desired to provide alternative configurations.

In U.S. Pat. No. 3,556,306, entitled SHELF SUPPORTING STRUCTURE AND JOINT THEREFORE, horizontal frame members are shown which span the distance between parallel cantilever supports. The horizontal component, shown again as shelving, rests upon the horizontal frame members. In such an embodiment, frame members of varying lengths must be provided to accommodate shorter or longer shelving arrangements. In addition, the system cannot be reconfigured to support a right-hand, left-hand or bridge-type shelf using the same bracket components.

SUMMARY OF THE INVENTION

Briefly stated, the invention is directed to a cantilever bracket assembly for attaching horizontal components to a side of a vertical wall. The bracket assembly includes a support member having rear portion adapted to releasably engage the wall and a substantially vertical web attached to the rear portion. The web has a first and second side. The bracket assembly also includes a bracket member adapted to engage a horizontal component, such as a worksurface member. A plurality of tab members are attached either to one of the first or second sides of the web by laterally offsetting the tab members from that side, or to the bracket member. A plurality of hanger members are attached and extend laterally outward from the other of the web or bracket member. The hanger members are disposed on the tab members to releasably attach the bracket member on the support member.

In a preferred embodiment of the invention, the tab members are laterally offset from both the first and second sides of the web and the hanger members are attached to the bracket member. The tab and hanger members are arranged so that the bracket member can be installed on either the first or second side of the web, or so that two brackets can be installed on both sides at the same time. Preferably, the support member includes four tab members: two tab members laterally offset from the first side of the web, and two tab members laterally offset from the second side. The rear portion of the support member preferably includes a plurality of lug members adapted to engage a vertical hanger bracket positioned in the vertical wall.

Also in the preferred embodiment, the bracket member includes a vertical flange and a horizontal flange. A pair of hanger members extend outwardly from the vertical flange and define the openings adapted to receive the tab members. Preferably, the hanger members are arranged so that the bracket member can be installed on either side of the web, and so that the bracket member is positioned the same distance from the rear portion of the support member regardless of which side it is installed on. The horizontal flange is adapted to support various horizontal components on the vertical wall, such as work surface members.

In another aspect of the invention, a land portion is laterally offset from each side of the web portion. Each of the land portions lie in substantially the same plane as the tab members offset from the same side. The land portion on either side engages the vertical flange of a bracket member when that bracket member is disposed on the tab members offset from the same side as the land portion so as to prevent the bracket member from rotating when loaded.

The present invention provides significant advantages over other bracket assemblies. Most importantly, a user can easily configure the bracket assembly in one of three different ways using a single support member and one or more substantially similar bracket members. In particular, the bracket members can be installed interchangeably on one or both sides of the support member so as to support various configurations of horizontal components. Thus, a single support member can be configured as a right-hand bracket, a left-hand bracket or as an intermediate bridge-type bracket simply by positioning one or more of the bracket members on the left side of the support member, the right side or both sides respectively. Therefore, a user need only maintain two types of parts in inventory, i.e., support members and bracket members, rather than an assortment of various bracket componentry.

In addition, one or more bracket members can be easily installed on the support member simply by inserting the tab members into corresponding hanger members. The assembly, therefore, avoids complicated and inaccessible mechanical fasteners.

Moreover, each bracket assembly provides independent support for the horizontal components. As such, each assembly can be attached at any location on the wall, regardless of the distance between the assembly and adjacent assemblies, because the positioning of the brackets and the space between them is not dependent on the length of the component being supported, or the length of any other structural member extending between the assemblies, so long as the bracket is located somewhere beneath the component.

The present invention, together with further objects and advantages, will be best understood by reference to the following detailed description taken in conjunction with the accompanying drawings.

DETAILED DESCRIPTION OF THE PREFERRED EMBODIMENT

Figure 1:
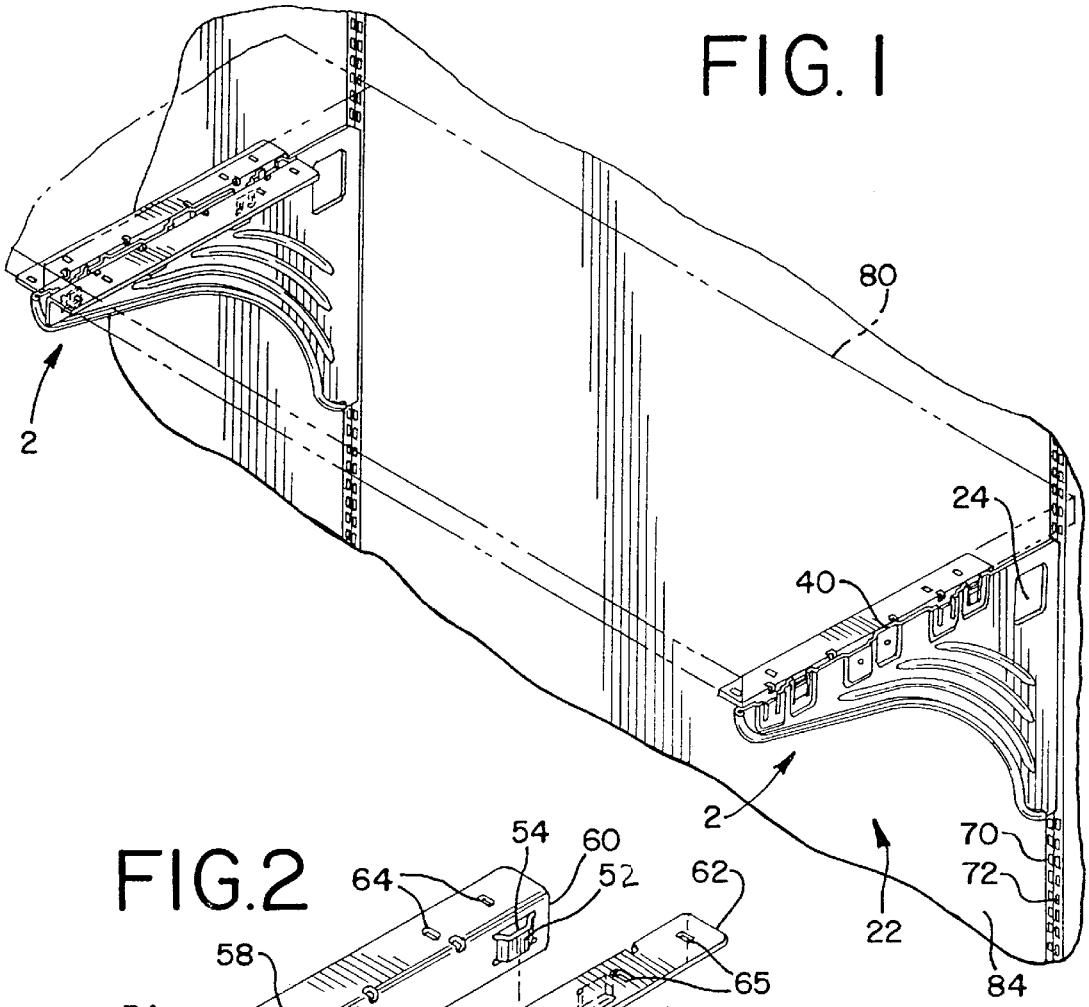
FIG. 1 is a perspective view of two cantilever bracket assemblies attached to the side of a vertical wall.
Figure 3:
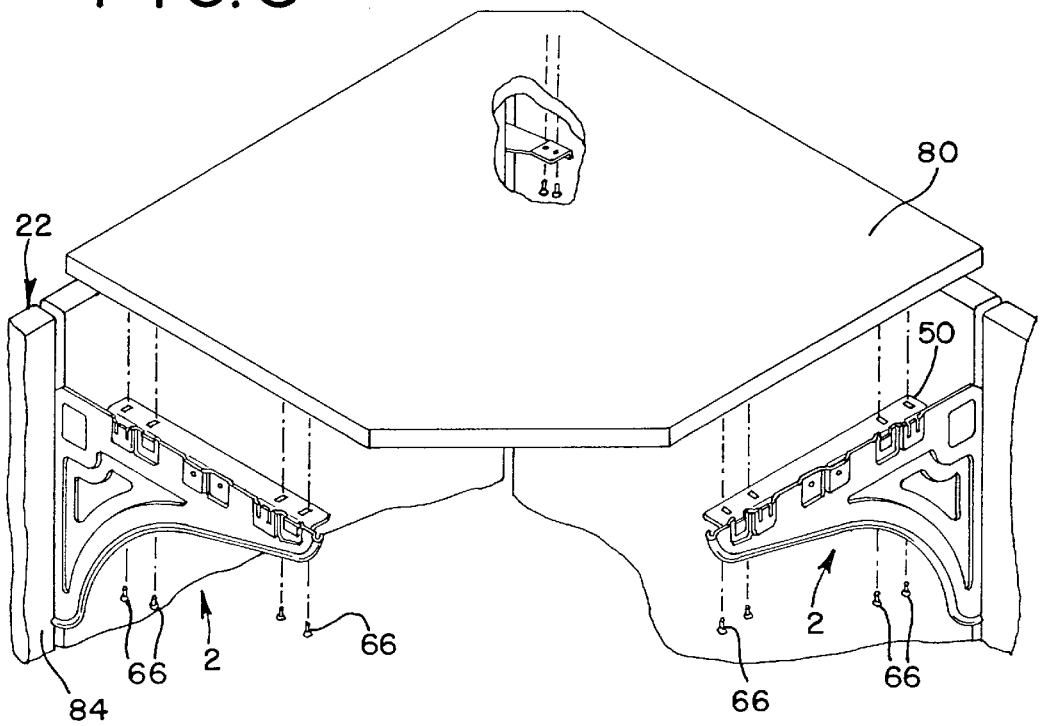
FIG. 3 is an exploded perspective view of two cantilever bracket assemblies with a corner worksurface member.

Referring to the drawings, FIGS. 1 and 3 show a pair of cantilever bracket assemblies 2 releasably attached to the side 84 of a vertical wall 22. Each bracket assembly 2 includes a support member 10 and a bracket member 50, preferably made out of metal. The bracket assemblies are adapted to support various horizontal components on the wall 22. As shown in FIG. 3, the horizontal component is configured as a worksurface member 80, although it should be understood that other components, such as cabinets, shelving and the like, can also be attached to a wall using the cantilevered bracket assembly. Thus, the disclosure of the worksurface member is meant to be illustrative rather than limiting.

Referring to FIGS. 1, 2, 4 and 5, the support member has a rear portion 20 adapted to releasably engage one of a pair of vertical hanger brackets 70 located in the wall 22. In particular, the rear portion 20 includes a rear edge 21 and a plurality of rearwardly extending lug members 28 that are adapted to engage a plurality of slots 72 positioned in one of the hanger brackets 70. The uppermost lug member 31 has an elongated, upwardly extending tang member 29. To attach the support member 10 to the wall, the elongated tang member 29 is first inserted into one of the slots 72 in one of the hanger brackets 70. The support member 10 is then rotated until the remaining lug members 28 are aligned with the corresponding slots 72. The lug members 28 are then inserted into the slots 72 and the support member 10 is lowered until the lug members 28 engage the hanger bracket 70. Once installed, the elongated tang member 29 prevents the support member 10 from becoming dislodged, as the support member 10 must be lifted upwardly and rotated outwardly in order to disengage the tang member 29.

Alternatively, the rear portion of the support member can be adapted to be attached to a flat wall, such as a permanent wall having wall board attached to a plurality of spaced apart internal studs. In such an embodiment, the rear portion includes a flange that is adapted to be directly attached to the wall with a plurality of fasteners. Alternatively, a hanger bracket can be attached to the flat wall with a plurality of fasteners, wherein the bracket assembly is mounted on the hanger bracket as described above.

A substantially vertical web 12 extends forwardly from the rear portion 20. The web 12 has a hole 24 positioned along the rear portion 20 so as to allow cables to pass from one side of the web 12 to the other. In this way, cables and power lines can be easily routed beneath adjacent worksurface members supported by the bracket assembly 2. The web 12 also has a beaded portion 26 running along the bottom edge of the web 12 to strengthen the web 12 and to provide resistance to buckling. The beaded portion 26 preferably is formed by rolling the bottom edge of the web over on itself. The bead also provides a wider, rounded edge at the bottom of the support member, which prevents the user from being exposed to any sharp edges. Similarly, raised portions 27 of the web can be employed to strengthen the web. The raised portions can be formed by stamping the web.

Figure 2:
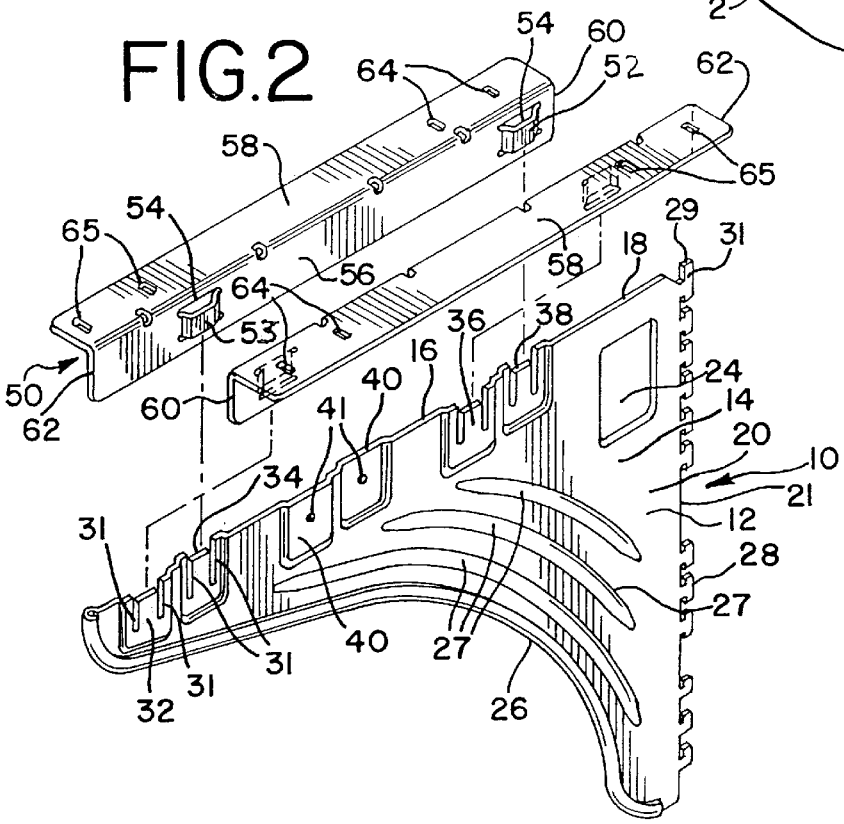
FIG. 2 is an exploded perspective view of a cantilever bracket assembly.
Figure 5:
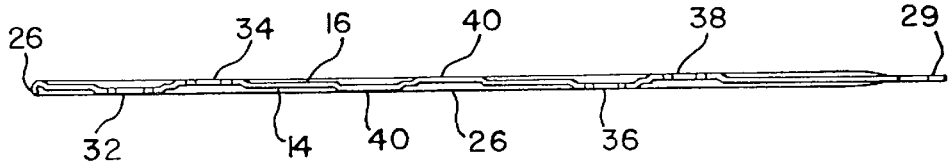
FIG. 5 is a top view of a support member.
Figure 6:
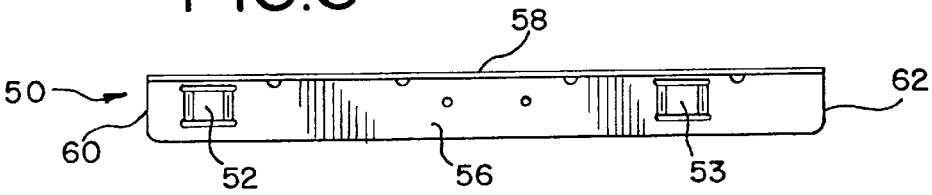
FIG. 6 is a side view of a bracket member
Figure 7:
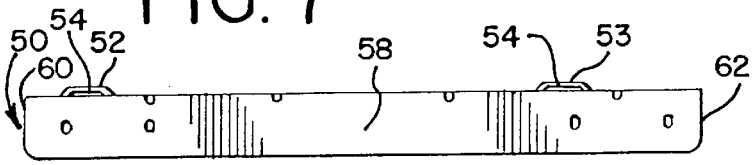
FIG. 7 is a top view of a bracket member.
Figure 8:
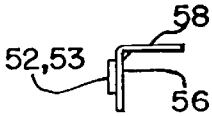
FIG. 8 is a end view of a bracket member.
Figure 12:
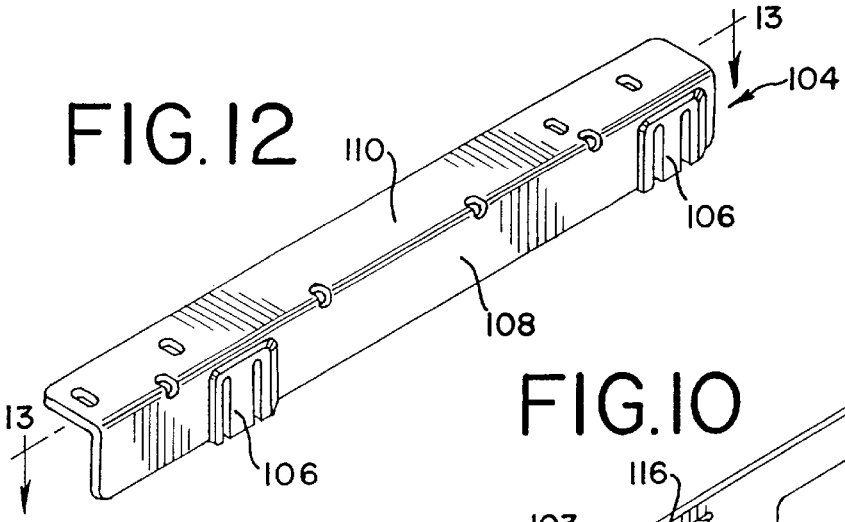
FIG. 12 is a perspective view of an alternative embodiment of the bracket member.
Figure 10:
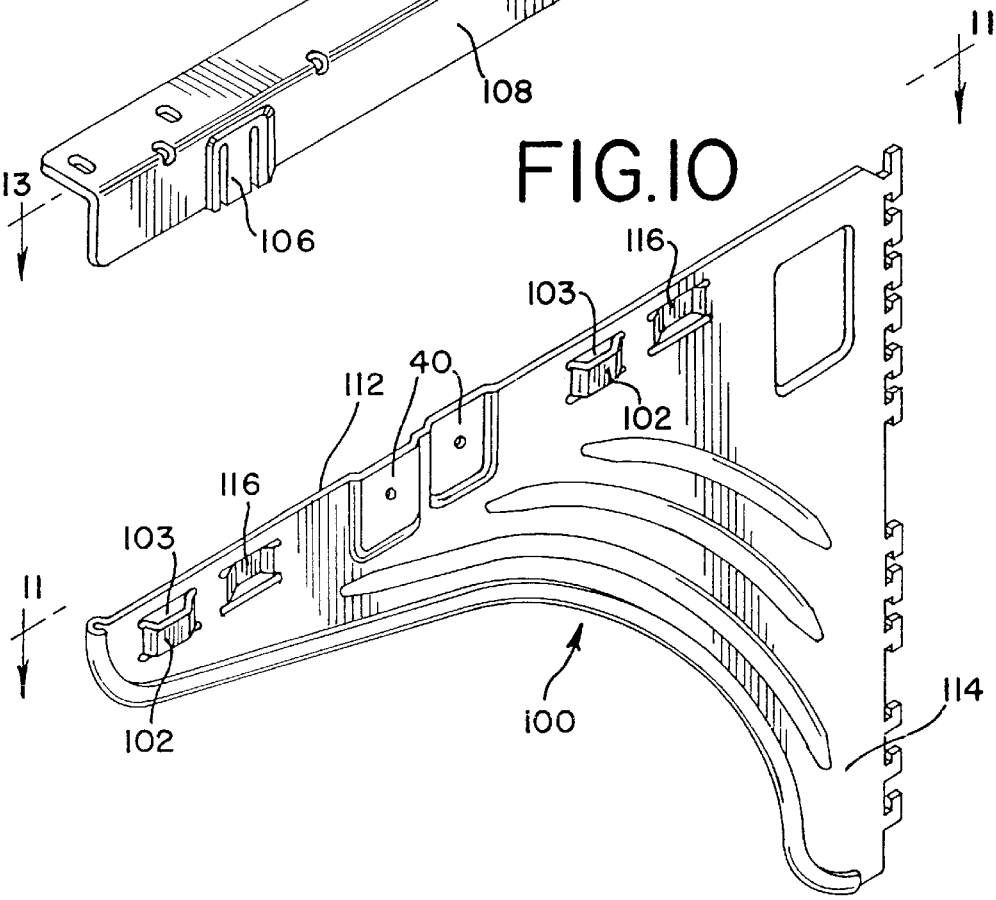
FIG. 10 is a perspective view of an alternative embodiment of the support member.
Figure 11:
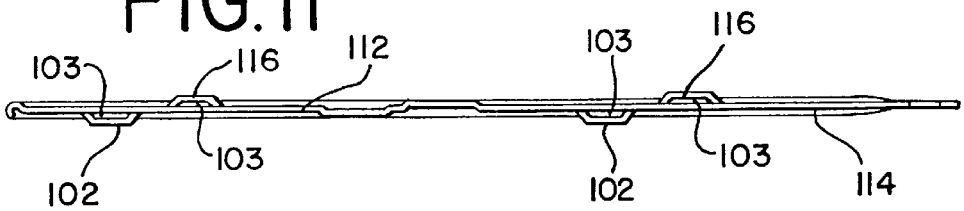
FIG. 11 is a top view of an alternative embodiment of the support member.
Figure 13:
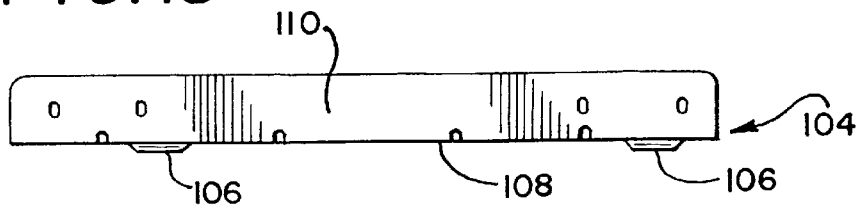
FIG. 13 is a top view of an alternative embodiment of the bracket member.

As shown in FIGS. 2 and 5, the web 12 has a first side 14, a second side 16 and a top edge 18. A plurality of upwardly extending tab members, preferably including a first tab member 32 and a third tab member 36, are laterally offset from the first side 14 of the web along the top edge 18. Similarly, a plurality of upwardly extending tab members, preferably including a second tab member 34 and a fourth tab member 38, are laterally offset from the second side 16 of the web 12 along the top edge 18. The first and third tab members 32, 36 lie in substantially the same plane, which is offset from the first side 14. The second and fourth tab members 34, 38 also lie in substantially the same plane, which is offset from the second side 16.

Figure 4:
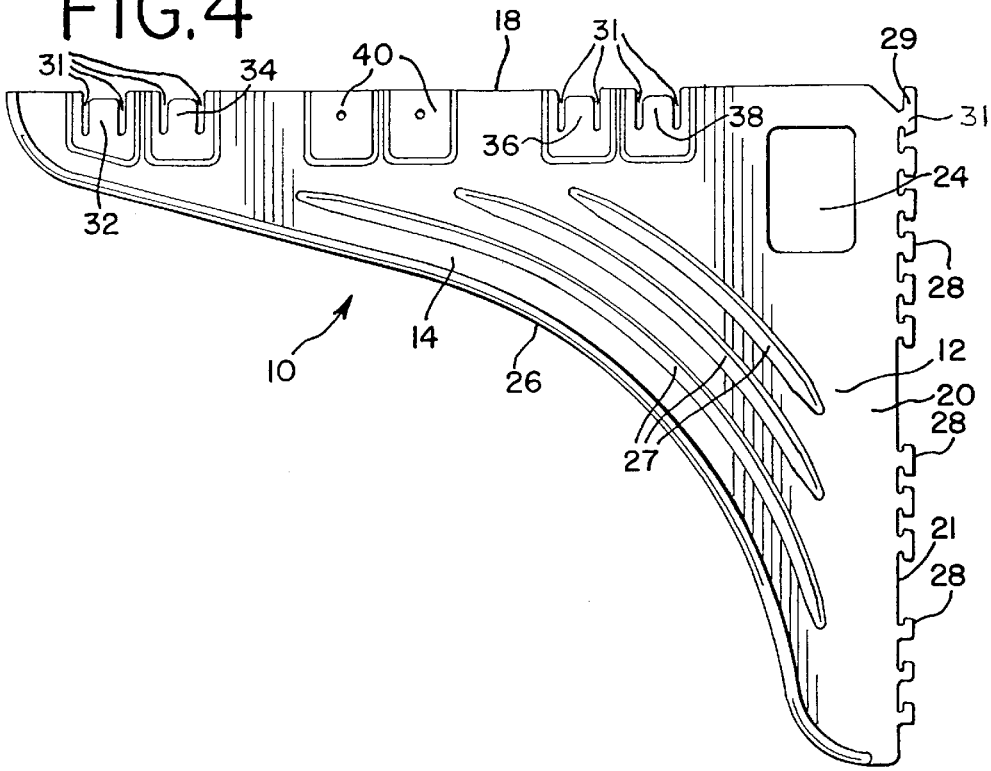
FIG. 4 is a side view of a support member.

In a preferred embodiment, shown in FIGS. 4 and 5, the first tab member 32 is offset from the first side 14 along a forward portion of the top edge 18. The second tab member 34 is positioned immediately adjacent to and rearward of the first tab member 32. The third tab member 36 is positioned along a rear portion of the top edge 18 of the web 12, and the fourth tab member 38 is positioned immediately adjacent to and rearward of the third tab member 36.

Preferably, all of the tab members 32, 34, 36, 38 are integrally formed with the web 12 by stamping the web 12 and providing reliefs 31 in the web to form the tab members. Although the preferred embodiment has been described as including four tab members, it should be understood that alternative embodiments could include more or less tab members. Thus, the four-tab configuration is meant to be illustrative rather than limiting.

Referring to FIGS. 2, 4 and 5, the support member 10 also includes a land portion 40 extending from each of the first and second sides 14, 16 between the second and third tab members 34, 36. The land portion 40 extending from the first side 14 lies in substantially the same plane as the first and third tab members 32, 36. The land portion 40 extending from the second side 16 lies in substantially the same plane as the second and fourth tab members 34, 38.

As shown in FIGS. 2 and 6–8, the bracket member 50 includes a horizontal flange 58 and a vertical flange 56. Preferably, the bracket member 50 is L-shaped, with the horizontal and vertical flanges 58, 56 joined at adjacent edges. A plurality of hanger members, including a first and second hanger member 52, 53, extend outwardly from the vertical flange. As shown in FIG. 2, the hanger members 52, 53 extend outwardly from a side of the vertical flange opposite the horizontal flange 58. The hanger members 52, 53 each form an opening 54 that is adapted to receive one of the tab members. Although the bracket member is shown as having two hanger members, it should be understood that it may have more or less hanger members, depending on the number of tab members attached to the support member.

In a preferred embodiment, as shown in FIG. 2, the distance between the first and third tab members 32, 36 is the same as the distance between the second and fourth tab members 34, 38 and as between the first and second hanger members 52, 53. In this way, the bracket member 50 can be installed on either the first or second side 14,16 of the support member 10, and can releasably engage either a first pair of tab members comprised of the first and third tab members 32, 36, or a second pair of tab members comprised of the second and fourth tab members 34, 38. As such, the bracket member 50 can be installed on either side of the support member 10 so as to support a horizontal component extending outwardly from either side. Moreover, two brackets can be installed on the support member 10 opposite each other, i.e., one mounted on the first and third tab members 32, 36 and the other on the second and fourth tab members 34, 38, so as to provide support for one or more horizontal components extending from both sides of the support member.

In a preferred embodiment, the bracket member has a first end 60 and a second end 62. Preferably, the second hanger member 53 is positioned a distance from the second end 62 equal to the distance of the first hanger member 52 from the first end 60 of the bracket member plus the distance between the centerlines of the first and second tab members 32, 34, or the third and fourth tab members 36, 38. When arranged in this manner, a first bracket member installed on the first and third tab members 32, 36 will be aligned with and be directly opposite to a second bracket member installed on the second and fourth tab members 34, 38. Accordingly, the two bracket members will be maintained in substantially the same spatial relationship to the rear edge 21 of the web 12 when installed on the first and second sides 12, 14 respectively, as shown in FIGS. 1 and 2.

As shown in FIGS. 1–3, the bracket member 50 is installed by disposing the hanger members 52, 53 on the tab members 32, 34, 36, 38. When mounted in this manner, the vertical flange 56 also engages the land portion 40 as it is in the same plane as the tab members. Thus, the bracket member 50 is installed simply by sliding the hanger members 52, 53 onto the tab members. In addition, a fastener can be installed at opening 41 in the land portion 40 to prevent separation of the bracket member 50 and support member 10.

In an alternative embodiment, shown in FIGS. 10–13, the support member 100 is provided with a plurality of hanger members 102, 116 each defining an opening 103. Each bracket member 104 is provided with a plurality of downwardly extending tab members 106 laterally offset from the vertical flange 108 opposite the horizontal flange 110. In essence, the hanger members and tab members are exchanged as between the support member and bracket member, whereby the support member preferably includes four hanger members: two hanger members 102 extending from the first side 114 of the web and two hanger members 116 extending from a second side 112. Similarly, the bracket member has two tab members 106. As described above, the hanger members 102, 116 and tab members 106 are arranged so that the bracket member 104 can be installed on either or both sides of the support member 100 and so that bracket members installed on both sides are substantially aligned and spaced approximately the same distance from the rear portion of the support member.

Referring to FIG. 2, the horizontal flange 58 on each bracket member 50 is provided with four elongated holes 64, 65, or slots. The distance between a first pair of slots 64 and as between a second pair of slots 65 is the same as between the centerlines of the first and second tab members 32, 34, and as between the centerlines of the third and fourth tab members 36, 38. As shown in FIG. 3, the work surface member 80 is typically secured to the horizontal flange 58 with a plurality of fasteners 66 extending through the elongated holes 64, 65.

The holes in the horizontal flange are slotted so as to accommodate the offset of the support member 10 relative to the side edge of the horizontal worksurface member when the bracket assembly is attached to one of two adjacent hanger brackets located at the interface of adjacent panels. In the configuration disclosed, each panel includes a hanger bracket mounted at each of the two ends of the panel. When two panels are installed adjacent to each other, the hanger brackets on opposing ends of the panels are drawn together. For example, the Q-SYSTEM™ work space management system, available from Herman Miller, Inc., Zeeland, Mich., employs this type of connector system. The wall panel construction, including the hanger bracket connection, is fully described in U.S. Provisional Patent Application Ser. No. 60/018,956, entitled WALL PANEL SYSTEM and filed Jun. 7, 1996, the disclosure of which is hereby incorporated by reference.

Because both hanger brackets have mounting slots, those slots are slightly offset from the centerline of the panel interface, and a bracket assembly mounted on either one of the adjacent hanger brackets also is slightly offset from the centerline of the panel interface. Because the holes in the horizontal flange of the bracket member are slotted, however, the bracket assembly can be mounted on either hanger bracket and still be aligned with corresponding mounting holes in a horizontal component aligned with the other hanger bracket. For example, when the bracket assembly is mounted on a hanger bracket in a panel extending away from a first side of the bracket assembly, the slots on a bracket member mounted on the second side of the bracket assembly can accommodate fasteners securing a work surface member extending away from the second side.

It should be understood that other panel systems do not have offset hanger brackets, but rather position a single standard, having hanger slots, between adjacent panels. In such an embodiment, the hanger slots in the standard are positioned at the panel interface, and the attached bracket assembly extends from that interface, thereby making the slotted holes in the horizontal flanges unnecessary. Similarly, when the bracket is attached directly to a flat wall, without using hanger brackets, the bracket can be positioned at any location so that the slotted holes are not necessarily needed for alignment.

Figure 9:
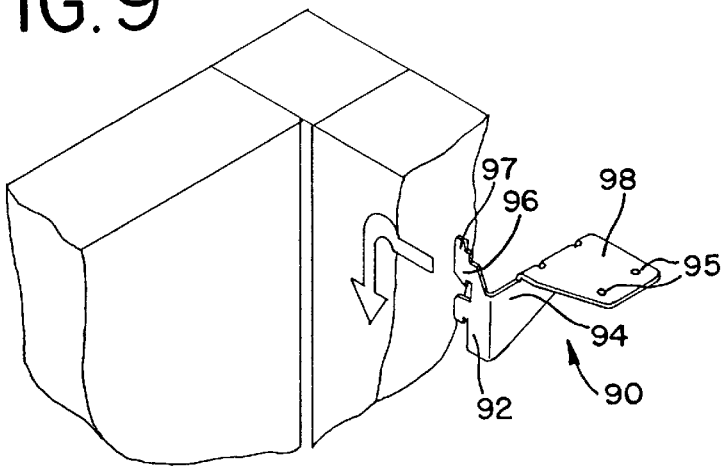
FIG. 9 is a perspective view of a support clip.

In another aspect of the invention, shown in FIG. 9, a support clip 90 is provided to support a worksurface member 80 in place of the cantilever bracket assembly. Typically, such a clip is installed at a location where there is no significant bending moment being transferred, such as in the back corner of a worksurface member as shown in FIGS. 3 and 9. In essence, the clip 90 is designed to transfer shear loads and small bending moments from the worksurface member to the wall.

The clip 90 has a rear portion 92 with a pair of lug members; the upper most lug member 96 having a elongated tang member 97 which prevents dislodgement of the clip when installed, as described above. The clip 90 also includes a brace member 94 extending upwardly from the rear portion 96 and a horizontal support surface 98 attached to the brace member 94. The support surface 98 is adapted to engage a horizontal component, such as a worksurface member, and includes two holes 95 which are adapted to receive fasteners that engage the worksurface member.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

We claim:

1. A cantilever bracket assembly comprising:

a support member comprising a rear portion adapted to releasably engage a wall and a substantially vertical web attached to the rear portion, said web having a first and second side;

at least one bracket member releasably mounted on said support member said bracket member comprising a side;

a plurality of tab members attached to one of said web and said bracket member, wherein said tab members are laterally offset from one of said web on each of said first and second sides of said web and said bracket member on said side of said bracket member; and a plurality of hanger members attached to the other of said web and said bracket member, wherein said hanger members extend laterally outward from one of said web on each of said first and second sides of said web and said bracket member on said side of said bracket member, said hanger members engaging said tab members to releasably mount said bracket member to said support member;

whereby said bracket member can be releasably mounted on one of said first and second sides of said support member.

2. The assembly of claim 1 wherein said web has a hole positioned in said rear portion so as to allow cables to pass from one side of said web to the other side.

3. The assembly of claim 1 wherein one of said plurality of said tab members and said hanger members are integrally formed with said web.

4. The assembly of claim 3 wherein said tab members are formed integrally with said web, wherein said tab members are formed by stamping said support member.

5. The assembly of claim 1 wherein said web includes a beaded portion along a bottom edge of the web.

6. The assembly of claim 1 wherein said bracket member comprises a vertical flange, wherein one of said plurality of said tab members and said hanger members are attached to said vertical flange.

7. The assembly of claim 6 wherein said tab members extend upwardly and are attached to said web and said hanger members are attached to said vertical flange of said bracket member, and said support member further comprises a land portion laterally offset from said web on at least one of said first and second sides along said top edge of said support member, said land portion lying in substantially the same plane as said tab members laterally offset on said at least one of said first and second side, wherein said land portion engages said vertical flange of said bracket member when said bracket member is disposed on said support member.

8. The assembly of claim 7 wherein said land portion is integrally formed with said web.

9. The assembly of claim 6 wherein the bracket member further comprises a horizontal flange member extending from said vertical flange.

10. The assembly of claim 9 wherein said vertical and horizontal flanges are attached at adjacent edges so that said bracket member is L-shaped.

11. The assembly of claim 9 wherein said horizontal flange has an elongated slot.

12. The assembly of claim 1 wherein said support member comprises a rear portion, said rear portion comprising a plurality of rearwardly extending lug members.

13. The assembly of claim 12 wherein said plurality of lug members comprises an uppermost lug member having an elongated upwardly extending tang member, said tang member adapted to releasably engage said wall.

14. A cantilever bracket assembly comprising:

a support member comprising a rear portion adapted to releasably engage a wall and a substantially vertical web attached to the rear portion, said web having a first and second side and a top edge, said support member further comprising a plurality of upwardly extending tab members horizontally spaced on said web, said tab members laterally offset from said web on each of said first and second sides; and at least one bracket member having a plurality of openings adapted to receive said tab members on one of said first and second sides of said support member, wherein said bracket member is mounted on said support member by disposing said tab members in said openings;

whereby said bracket member can be releasably mounted on one of said first and second sides of said support member.

15. A cantilever bracket assembly comprising:

a support member comprising a substantially vertical web having a first and second side;

at least one bracket member releasably mounted on said support member;

a plurality of downwardly extending tab members attached to said bracket member, said plurality of tab members comprising at least a pair of tab members extending downwardly from said bracket member;

a plurality of hanger members comprising at least a first pair of hanger members extending laterally outward from said first side of said web, and at least a second pair of hanger members extending laterally outward from said second side of said web, wherein said first and second pairs of hanger members are staggered in a spaced apart relationship along said web, and wherein said pair of tab members are disposed in one of said first and said second pairs of hanger members to releasably attach said bracket member to said support member;

wherein the distance between said spaced apart hanger members comprising said first pair of hanger members is approximately the same distance as between the spaced apart hanger members comprising said second pair and which is approximately the same distance as between the tab members attached to said bracket member;

whereby said bracket member can be releasably mounted on either said first or second sides of said support member.

16. The assembly of claim 15 wherein support member comprises a rear portion and wherein said tab members are arranged such that said bracket member is positioned approximately the same distance from the rear portion of said support member when said bracket member is disposed on one of said first and second pair of hanger members;

whereby said bracket member can be installed interchangeably on one of said first and second pair of hanger members such that said bracket member is maintained in substantially the same spatial relationship to said rear portion when installed on one of said first and second pairs of hanger members.

17. The assembly of claim 16 wherein said bracket member is disposed on said first pair of hanger members, and further comprising a second bracket member substantially similar to said first bracket member and comprising a pair of tab members disposed on said second pair of hanger members, wherein said first and said second pair of hanger members and said tab members on said first and second bracket members are arranged such that said first and second bracket members are substantially aligned with and positioned opposite each other when installed on the support member.

18. A cantilever bracket assembly comprising:

a support member comprising a substantially vertical web having a first and second side;

at least one bracket member releasably mounted on said support member;

a plurality of upwardly extending tab members attached to said web, wherein said tab members are laterally offset from said web on said first and second sides of said web, said plurality of tab members comprising at least a first pair of tab members offset from said web on the first side of said web, and at least a second pair of tab members offset from said web on the second side of said web, wherein said first and second pairs of tab members are horizontally staggered in a spaced apart relationship along said web; and at least a pair of hanger members extending from said bracket member and adapted to engage one of said first and said second pairs of tab members, said pair of hanger members disposed on one of said at least said first and second pairs of tab members to releasably attach said bracket member to said support member;

wherein the distance between said spaced apart tab members comprising said first pair of tab members is approximately the same distance as between the spaced apart tab members comprising said second pair and which is approximately the same distance as between the hanger members extending from said bracket member;

whereby said bracket member can be releasably mounted on either said first or second sides of said vertical web.

19. The assembly of claim 18 wherein said support member comprises a rear portion and wherein said hanger members are arranged on said bracket member such that said bracket member is positioned approximately the same distance from a rear portion of said support member when said bracket member is disposed on one of said first and second pair of tab members;

whereby said bracket member can be installed interchangeably on one of said first and second pair of tab members such that said bracket member is maintained in substantially the same spatial relationship to said rear portion when installed on one of said first and second pairs of tab members.

20. The assembly of claim 19 wherein said bracket member is disposed on said first pair of tab members, and further comprising a second bracket member substantially similar to said first bracket member and comprising a pair of hanger members disposed on said second pair of tab members, wherein said first and said second pair of tab members and said hanger members on said first and second bracket members are arranged such that said first and second bracket members are substantially aligned with and positioned opposite to each other when installed on the support member.

21. A cantilever bracket assembly comprising:

a support member comprising a substantially vertical web having a first and second side, said support member further comprising a plurality of upwardly extending tab members attached to said web, said tab members laterally offset from said web on each of said first and second sides, wherein said plurality of tab members comprises at least a first pair of tab members offset from said web on the first side of said web, and at least a second pair of tab members offset from said web on the second side of said web portion, wherein said first and second pairs of tab members are horizontally staggered in a spaced apart relationship along said web; and at least one bracket member having a plurality of openings adapted to receive said tab members, wherein said bracket member is mounted on said support member by disposing said tab members in said openings, wherein said plurality of openings is defined by at least a pair of hanger members extending from said bracket member and adapted to engage one of said first and said second pairs of tab members;

wherein the distance between said spaced apart tab members comprising said first pair of tab members is approximately the same distance as between the spaced apart tab members comprising said second pair and which is approximately the same distance as between the hanger members extending from said bracket member;

whereby said bracket member can be releasably mounted on either said first or second sides of said support member.

22. The assembly of claim 21 wherein said support member comprises a rear portion and wherein said hanger members are arranged on said bracket member such that said bracket member is positioned approximately the same distance from the rear portion of said support member when said bracket member is disposed on one of said first and second pair of tab members;

whereby said bracket member can be installed interchangeably on one of said first and second pair of tab members such that said bracket member is maintained in substantially the same spatial relationship to said rear portion when installed on one of said first and second pairs of tab members.

23. A bracket assembly for attaching a component to a side of a vertical wall, said bracket assembly comprising:

a support member comprising a web having a first and second side, a top edge, an upwardly extending first tab member laterally offset from said web on said first side along a forward portion of said top edge, an upwardly extending second tab member laterally offset from said web on said second side adjacent to and rearward of said first tab member, an upwardly extending third tab member laterally offset from said web on said first side along a rear portion of said top edge, and an upwardly extending fourth tab member laterally offset from said web on said second side adjacent to and rearward of said third tab member; and a bracket member comprising a first and second end, a first and second hanger member and a vertical flange, said first and second hanger members extending from said vertical flange, said hanger members adapted to releasably engage one of a pair of said first and third tab members and a pair of said second and fourth tab members;

whereby said bracket member can be installed interchangeably on one of said pair of tab members so as to support said component extending outwardly from one of said first and second sides of said support member.

24. The assembly of claim 23 wherein the distance between the first and third tab members is equal to the distance between the second and fourth tab members which is equal to the distance between the hanger members; and wherein said first hanger member is positioned an approximate distance from said first end of said bracket member equal to the sum of the approximate distance of said second hanger member from said second end of said bracket member and the approximate distance between a centerline of said first tab member and a centerline of said second tab member;

whereby said bracket member can be installed interchangeably on one of said first and third tab members and said second and fourth tab members, and whereby said bracket member is maintained in substantially the same spatial relationship to a rear edge of said web when installed on one of said first and third tab members and said second and fourth tab members respectively.

25. The assembly of claim 23 further comprising a second bracket member substantially similar to said first bracket, wherein said first bracket member is disposed on said first and third tab members, and said second bracket member is disposed on said second and fourth tab members, and wherein said tab members and said hanger members are arranged so that said first bracket member is substantially aligned with and positioned opposite said second bracket.

26. The assembly of claim 25 wherein said support member further comprises a first land portion laterally offset from said first side of said web along said top edge between said second and third tab members, and a second land portion laterally offset from said second side of said web along said top edge between said second and third tab members, said land portions lying in substantially the same plane as said tab members respectively, wherein said first and second land portions are adapted to engage said vertical flanges of said first and second bracket members when disposed on said support member;

whereby the weight of the component is transferred from said bracket members through said tab members, and whereby each of said bracket members is prevented from rotating by said vertical flanges contacting said land portions.

27. A cantilever bracket assembly comprising:

a support member comprising a rear portion adapted to releasably engage a wall and a substantially vertical web attached to the rear portion, said web having a first and second side and a top edge, said support member further comprising a plurality of hanger members extending laterally outward from said web on each of said first and second sides, each of said hanger members defining an opening, wherein said plurality of hanger members extending laterally outward from said first side of said support member are staggered in a spaced apart relationship with said plurality of hanger members extending laterally outward from said second side of said support member; and at least one bracket member having a plurality of downwardly extending tab members adapted to be received in said plurality of hanger members extending from one of said first and second sides of said support member, wherein said bracket member is mounted on said support member by disposing said tab members in said openings in said hanger members;

whereby said bracket member can be releasably mounted on one of said first and second sides of said support member.

28. The assembly of claim 27 wherein said plurality of hanger members comprises two hanger members extending outwardly from said first side of said web and two hanger members extending outwardly from said second side of said web, and wherein said plurality of tab members comprises two tab members.

29. A cantilever bracket assembly comprising:

a support member comprising a substantially vertical web having a first and second side and a top edge, said support member further comprising a plurality of hanger members extending laterally outward from said web on each of said first and second sides, each of said hanger members defining an opening; and at least one L-shaped bracket member comprising a vertical flange and a horizontal flange joined at adjacent edges, said bracket member having a plurality of downwardly extending tab members adapted to be received in said plurality of hanger members extending from one of said first and second sides of said support member, said tab members attached to and laterally offset from a side of said vertical flange opposite said horizontal flange, wherein said bracket member is mounted on said support member by disposing said tab members in said openings in said hanger members, and wherein said support member further comprises a land portion laterally offset from said web on at least one of said first and second sides along said top edge of said support member, wherein said land portion engages said vertical flange of said bracket member when said bracket member is disposed on said support member;

whereby said bracket member can be releasably mounted on one of said first and second sides of said support member and whereby the vertical flange prevents said bracket member from rotating by contacting said land portion.

30. A wall panel system comprising:

at least one wall panel having a vertical hanger bracket attached to an end of the panel, said hanger bracket having a plurality of slots;

a bracket assembly releasably mounted on said hanger bracket, said bracket assembly comprising:

a support member comprising a substantially vertical web having a first and second side, a top edge, a rear portion having a plurality of rearwardly extending lug members, said lug members releasably engaging said hanger bracket at said slots in said hanger bracket; and a pair of bracket members, each having a vertical flange and a horizontal flange, said bracket members mounted on opposite sides of said support member;

a plurality of tab members attached to one of said web and each of said bracket members, wherein said tab members are laterally offset from one of said web on each of said first and second sides of said web and each of said bracket members on said vertical flange of each of said bracket members;

a plurality of hanger members attached to the other of said web and each of said bracket members, wherein said hanger members extend laterally outward from one of said web on each of said first and second sides and each of said bracket members on said vertical flange of said bracket members, said hanger members engaging said tab members to releasably attach said bracket members to said support member.

31. The system of claim 30 wherein said tab members extend upwardly and are attached to said web and said hanger members are attached to said vertical flange of said bracket member, said support member further comprising a land portion laterally offset from said web on each of said first and second sides along said top edge of said support member, said land portions lying in substantially the same plane as said tab members, wherein said land portions engage said vertical flanges of said bracket members when said bracket member are disposed on said support members.

32. The system of claim 30 wherein said wall panel further comprises a second hanger bracket attached to a second end of said wall panel, said hanger bracket having a plurality of slots, and a second bracket assembly substantially similar to said first bracket assembly mounted on said second hanger bracket.

33. The support system of claim 32 further comprising a horizontal component supported by said first and second bracket assemblies.

34. The support system of claim 33 wherein said horizontal component is a worksurface member.

35. The support system of claim 33 wherein said plurality of lug members includes an uppermost lug member having an elongated upwardly extending tang member, wherein said elongated tang member engages one of said slots to prevent said bracket assembly from becoming dislodged.

36. The support system of claim 33 wherein each of said horizontal flanges has an elongated slot, and a fastener received in said slot and attaching said horizontal component to said flange.

* * * * *

UNITED STATES PATENT AND TRADEMARK OFFICE

CERTIFICATE OF CORRECTION

PATENT NO. : 6,019,331
DATED : February 1, 2000
INVENTOR(S) : Timothy A. Hoogland et al.

It is certified that error appears in the above-identified patent and that said Letters Patent is hereby corrected as shown below:

Title page,
Column 1, line 7, under "U.S. PATENT DOCUMENTS", delete "3,097,022" and substitute -- 3,097,822 -- in its place.

Claim 1,
Line 7, delete "support member" and substitute -- support member, -- in its place.

Claim 7,
Line 6, delete "along said top edge".

Claim 31,
Line 10, delete "bracket member" and substitute -- bracket members -- in its place.

Signed and Sealed this

Twenty-seventh Day of November, 2001

*Attest:*

Nicholas P. Godici

NICHOLAS P. GODICI
*Acting Director of the United States Patent and Trademark Office*

*Attesting Officer*